US007159628B2

(12) United States Patent
Stroud et al.

(10) Patent No.: US 7,159,628 B2
(45) Date of Patent: Jan. 9, 2007

(54) GANGSAW WITH A SPLIT SAWBOX

(75) Inventors: Brian Stroud, Salmon Arm (CA); Rory M. Mitchell, Hayden, ID (US)

(73) Assignee: Coe Newnes/McGehee Inc., Salmon Arm (CA)

( * ) Notice: Subject to any disclaimer, the term of this patent is extended or adjusted under 35 U.S.C. 154(b) by 0 days.

(21) Appl. No.: 11/052,134

(22) Filed: Feb. 8, 2005

(65) Prior Publication Data

US 2005/0172771 A1 Aug. 11, 2005

Related U.S. Application Data

(60) Provisional application No. 60/542,291, filed on Feb. 9, 2004.

(51) Int. Cl.
*B27B 31/00* (2006.01)
*B27C 1/12* (2006.01)
*B27C 5/02* (2006.01)

(52) U.S. Cl. ..... 144/242.1; 144/250.23; 144/3.1; 144/39; 144/246.1; 83/365

(58) Field of Classification Search ..... 144/398, 144/2.1, 242.1, 246.1, 246.2, 250.16, 357, 144/373, 378, 39, 116, 3.1, 117.1, 356, 250.23, 144/369; 83/665, 859
See application file for complete search history.

(56) References Cited

U.S. PATENT DOCUMENTS

| | | | | | |
|---|---|---|---|---|---|
| 2,102,186 | A * | 12/1937 | Nicholson et al. | ..... | 144/116 |
| 3,082,802 | A * | 3/1963 | Dickson et al. | ..... | 144/374 |
| 5,396,938 | A * | 3/1995 | Cannaday | ..... | 144/357 |
| 5,400,842 | A * | 3/1995 | Brisson | ..... | 144/398 |
| 5,735,029 | A | 4/1998 | Panetta | | |
| 5,816,302 | A * | 10/1998 | Newnes | ..... | 144/357 |
| 6,666,246 | B1 * | 12/2003 | Gilbert | ..... | 144/382 |

* cited by examiner

*Primary Examiner*—Bena Miller
(74) *Attorney, Agent, or Firm*—Antony C. Edwards

(57) ABSTRACT

A split sawbox for a gangsaw includes a sawbox having at least first and second mating sawbox sections. The sections are linearly selectively translatable relative to one another between a closed position wherein the sections are releasably locked together for operation of the gangsaw, and an open position wherein the sections are linearly separated from one another to open a gap within which a workman may stand for maintenance of the gangsaw.

9 Claims, 4 Drawing Sheets

32
B
48
46
44
38
6
36
42
6
A
26
62
64
64a
24
12a
30

50
58
54
56
36
56
52

GANGSAW WITH A SPLIT SAWBOX

CROSS REFERENCE TO RELATED APPLICATION

This application claims priority from U.S. Provisional Patent Application No. 60/542,291 filed Feb. 9, 2004 entitled Gangsaw with a Split Sawbox.

FIELD OF THE INVENTION

The present invention relates to a sawmill gangsaw, and in particular to a gangsaw where the infeed and outfeed may be separated along the workpiece flow path for ease of changing or tending to the saws and guides.

BACKGROUND OF THE INVENTION

Gangsaws for cutting wood cants and flitches (collectively herein workpieces) into boards are common in the wood processing industry. Gangsaws have an upstream infeed and an opposite downstream outfeed. Bed rolls and hold down rolls clamp the lower and upper surfaces of the workpiece in the respectively infeed and outfeed. A saw arbor, containing ganged circular saws, is rotatably mounted within a sawbox between the infeed and the outfeed. The workpiece is cut into boards in the sawbox prior to exiting through the outfeed.

Gangsaws require regular maintenance such as adjustment or replacement of the circular saws. In the past it has been difficult for gangsaw maintenance personnel to reach the middle section of the gangsaw to access and service the saws and guides. To partially overcome this, it is known in the prior art to hinge that portion of the infeed of the gangsaw above the bed roll level so that it may be opened in an upstream direction about the hinges by actuation of air or hydraulic cylinders. Once open, a maintenance workman climbs into the opening under the open, hinged infeed, sits on one of the bed rolls and proceeds to attend to maintenance of the saws and guides.

To change the saws and guides typically involves loosening and moving them sideways, that is, laterally to the direction of flow of the workpiece. Accordingly, the maintenance workman is typically seated in a crouched position on the bed rolls while attempting to move heavy loads sideways. This arrangement is known to be the cause of injury specifically back and neck injury. Where such gangsaws are coupled with chipping heads, on the infeed side of the saw arbor, servicing is equally awkward. It is therefore an object of this invention to allow for improved posture during such maintenance.

SUMMARY OF THE INVENTION

The present invention provides for a gangsaw where the outfeed of the gangsaw is slidably mounted on slideways enabling horizontal translation of the outfeed through actuation of a hydraulic or air cylinder or similar device, relative to the fixed infeed. Such translation permits the infeed and outfeed to be laterally separated at a joining interface which defines the infeed and outfeed sections of the gangsaw immediately toward the infeed side of the saw arbor for ease of entry by personnel for saw adjustment and maintenance. The interface contains horizontally aligned locking pins and receptacles which are mated and clamped when the infeed and outfeed are in the closed position to prevent accidental separation and to maintain the integrity of the machine.

The present invention further provides a flexible coupling from the saw drive motor to the saw arbor mounted in the outfeed of the gangsaw so that the motor may remain stationary while the outfeed of the gangsaw is translated along the workpiece flow path in a direction away from the infeed end of the gangsaw. The gangsaw according to the present invention includes at least two sections which may be translated horizontally relative to one another between.

a) a closed position wherein the sections are closely abutted and releasably locked together for operation of the gangsaw; and, b) an open position wherein the sections are separated horizontally a distance sufficient for a workman to stand between the separated sections.

The sections separate along a separation interface. The separation interface is adjacent the arrays of saws mounted on the arbors in the gangsaw, and also adjacent any other chipping or cutting machinery (collectively herein referred to as cutting machinery) mounted in the gangsaw which require manual maintenance by a workman. The workman may thus reach the saws and machinery within the gangsaw for maintenance.

In a preferred embodiment the sections are upstream and downstream sections and the translation between the open and closed positions is along the direction of infeed of workpieces into the gangsaw. In one embodiment, it is the downstream section which translates, the upstream section remaining fixed.

In summary, the present invention is a split gangsaw sawbox wherein at least first and second mating sections of the sawbox may be linearly selectively translated relative to one another between a closed position wherein the sections are releasably locked together for operation of the gangsaw, and an open position wherein the sections are linearly separated from one another to open a gap within which a workman may stand for maintenance of the gangsaw. The sections may translate relative to one another by one or the other of the sections, advantageously the downstream or outfeed section being translated relative to a fixed upstream or infeed section; in which case translation may advantageously be in the downstream direction of flow of workpieces through the gangsaw. Further advantageously a floor, which may be a temporary floor, is mounted under or adjacent the gangsaw for selectively actuable movement of the floor from a retracted position when the gangsaw sections are in the closed position, and an installed position for a workman to stand on when the gangsaw sections are in the open position. Yet further advantageously, the gangsaw motors may remain fixed so as to not translate as the outfeed section translates between the open and closed positions.

DETAILED DESCRIPTION OF EMBODIMENTS OF THE INVENTION

Figure 1:
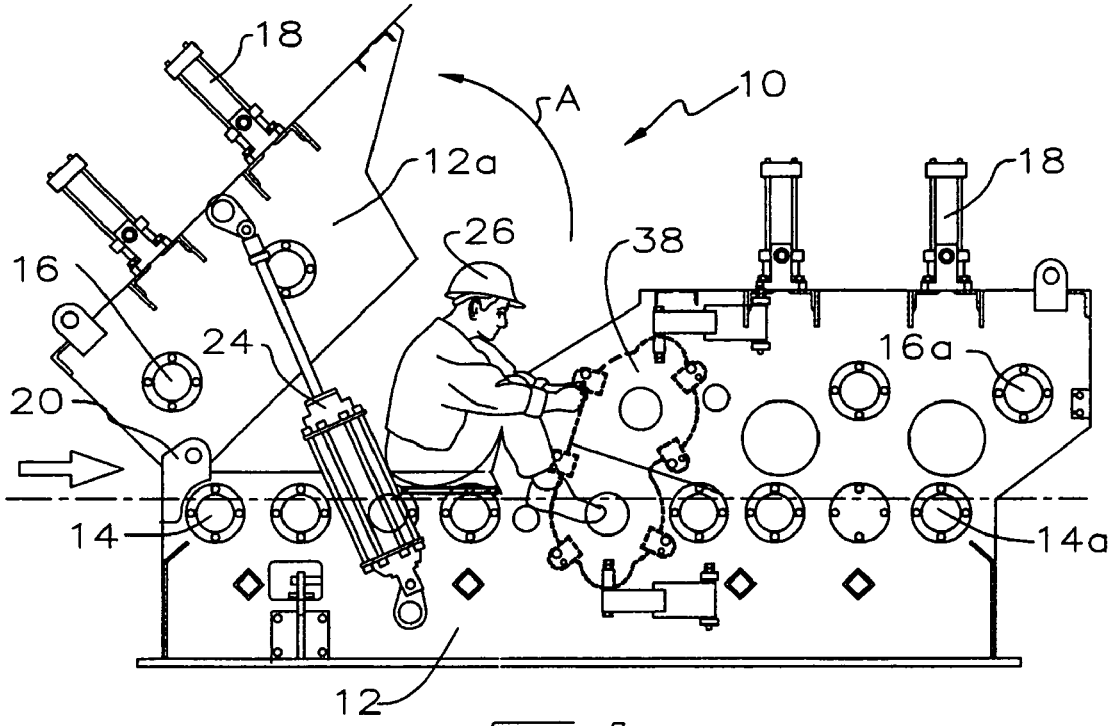
Fig 1 PRIOR ART
FIG. 1 is a side view of a prior art double arbor gangsaw in the open position.

FIG. 1 illustrates a prior art double arbor gangsaw 10 having a frame 12 supporting infeed and outfeed bedrolls 14 and 14*a* respectively and corresponding infeed and outfeed press rolls 16 and 16*a* respectively. Pneumatically operated cylinders 18 mounted to frame 12 ensure that rolls 14 and 16 firmly engage the workpieces as they pass through the gangsaw. To permit maintenance and repair of the saws an upper portion 12*a* of frame 12 over the infeed may be hinged at joint 20 so as to be rotated in direction A to its open position by air or hydraulic cylinder 24. Maintenance operator 26 then climbs into the exposed infeed upon bedrolls 14 and assumes a sitting or a crouched position resting on rolls 14 while shifting heavy saw guides.

In the present invention, as seen in FIGS. 2–6, wherein corresponding reference numerals represent like parts in each view, gangsaw frame 12 has separate infeed and outfeed sections 30 and 32 respectively, joined at interface 36. Interface 36 is more clearly seen in FIG. 3*a*, which is located a short distance toward the infeed from the gangsaw arbor 38. In one embodiment (not illustrated), gangsaw 10 may have chip heads mounted nearer to the infeed and mounted on infeed section 30. A portion of infeed section 30 above bed rolls 14 may be raised in direction A by cylinder 24 as in the prior art.

Infeed 30 may be pivoted in direction A but may not, in the illustrated embodiment be translated. Outfeed 32 may be selectively longitudinally translated relative to the infeed in direction B. In the illustrated embodiment, not intended to be limiting, outfeed 32 can have depending supports 42 which are slidably mounted on slideways 44 mounted to a base 46. A hydraulic cylinder 48 mounted at one end to outfeed 32 and at the other to base 46. When actuated, cylinder 48 reciprocally translates outfeed 32 in direction B towards or away from infeed 30.

Figure 2:
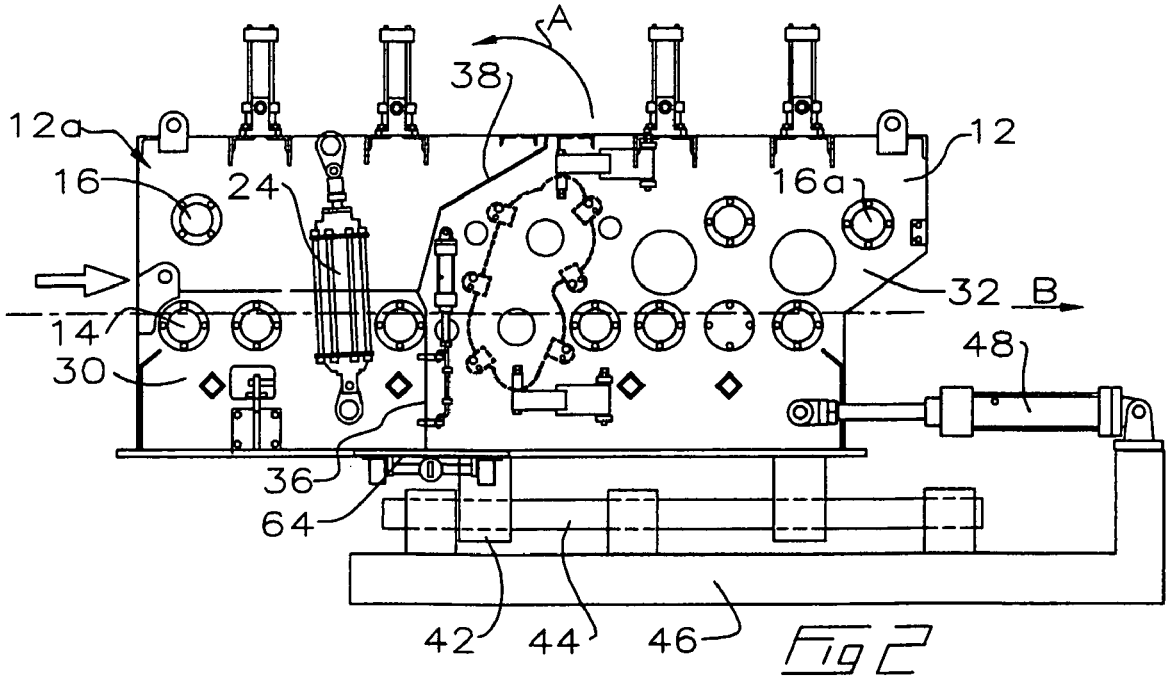
FIG. 2 is a side view of the gangsaw of the present invention in its closed position.
Figures 3, 3A:
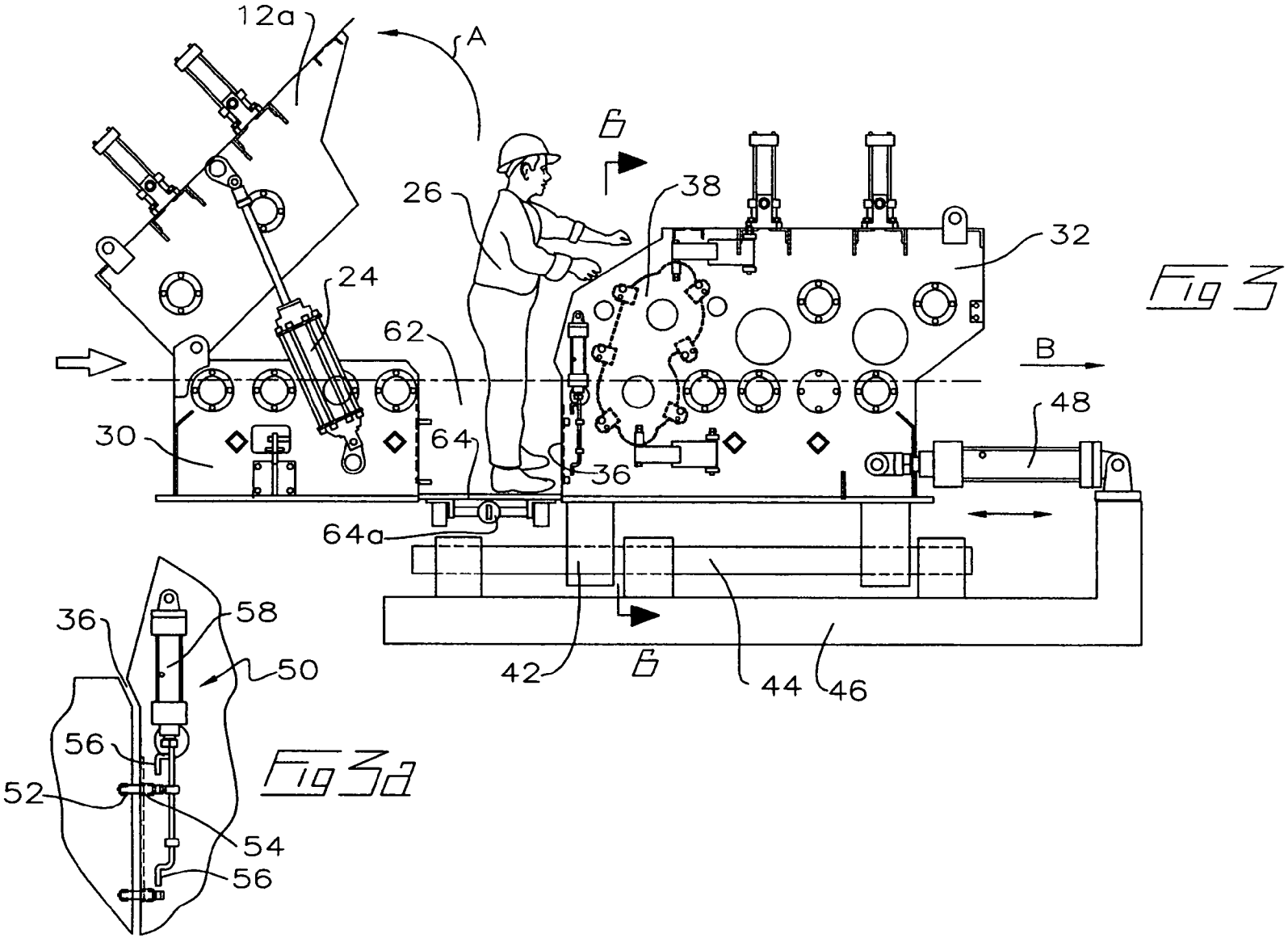
FIG. 3 is a side view of the gangsaw of the present invention in its open position.
FIG. 3*a* is an enlarged view of the locking mechanism of the gangsaw of FIG. 1.

In the closed position, as may be seen in FIG. 2, infeed and outfeed sections 30 and 32 abut at interface 36 and are held together by locking mechanism 50 better seen in FIG. 3*a*. In the illustrated embodiment, not intended to be limiting, locking mechanism 50 includes or comprises a mating pin 52 and sleeve 54 mounted respectively to infeed and outfeed sections 30 and 32. The projecting end of pin 52 is of sufficient length to extend through sleeve 54 and offset locking fingers 56 of hydraulic cylinder 58 which may engage apertures or recesses near the end of pin 52 to securely lock the two sections together. Fingers 56 are removed from engagement with the end of pin 52 to unlock the two sections so that they may be separated.

The downstream displacement in direction B of outfeed 32 from infeed 30 provides a servicing gap 62 within which maintenance operator 26 may stand to work unobstructed. In the illustrated example of FIG. 3, not intended to be limiting, the displacement of section 32 from section 30 is approximately three feet in distance. As better seen in FIG. 5, a retractable floor 64 may be mounted to one side of frame 12. The floor 64 is selectively slid or otherwise extended into gap 62 in direction C by the selective operation of a hydraulic cylinder 64*a* or other actuator. Maintenance operator 26 may then stand on floor 64 and conveniently access the saws and saw guides in the standing position.

Figure 4:
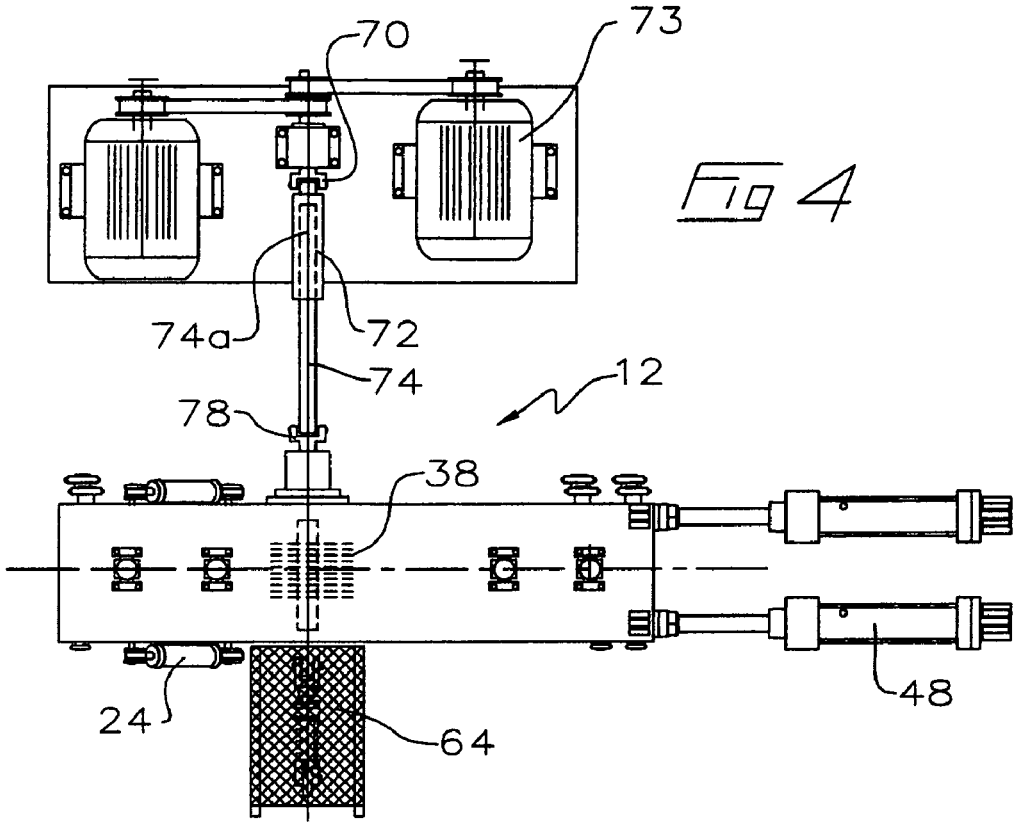
FIG. 4 is a plan view of the gangsaw of FIG. 2 in the closed position.
Figure 5:
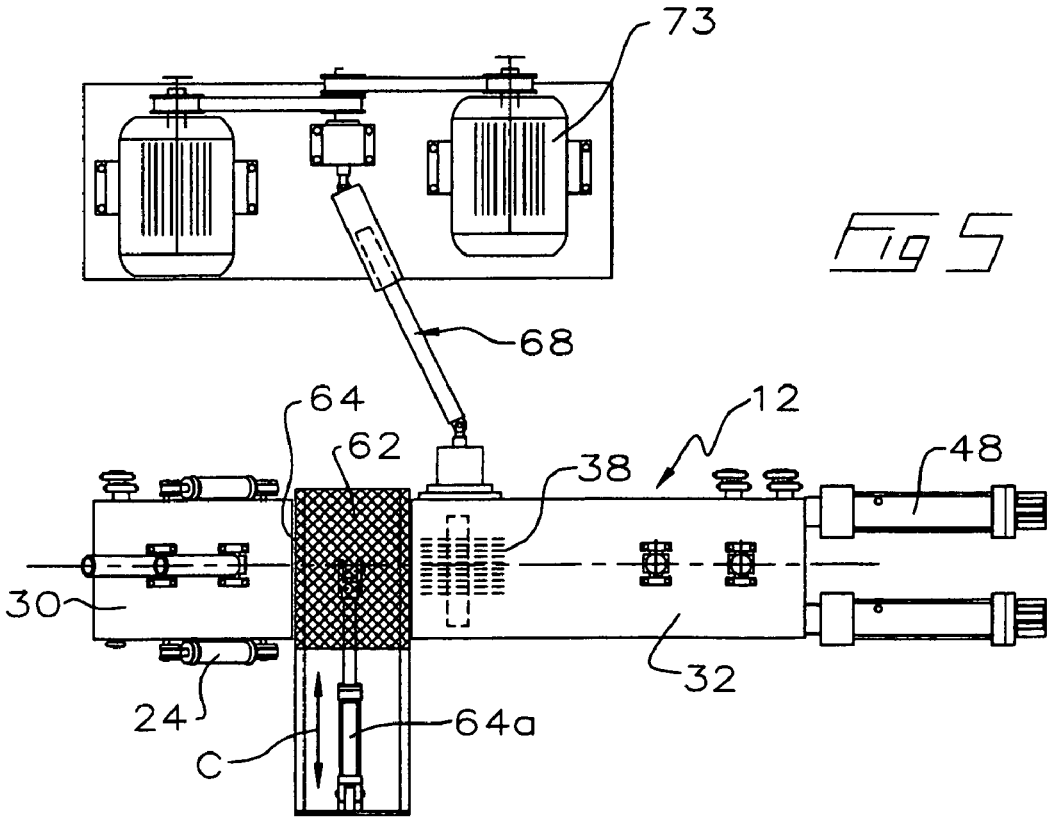
FIG. 5 is a plan view of the gangsaw of FIG. 3 in the open position.
Figure 6:
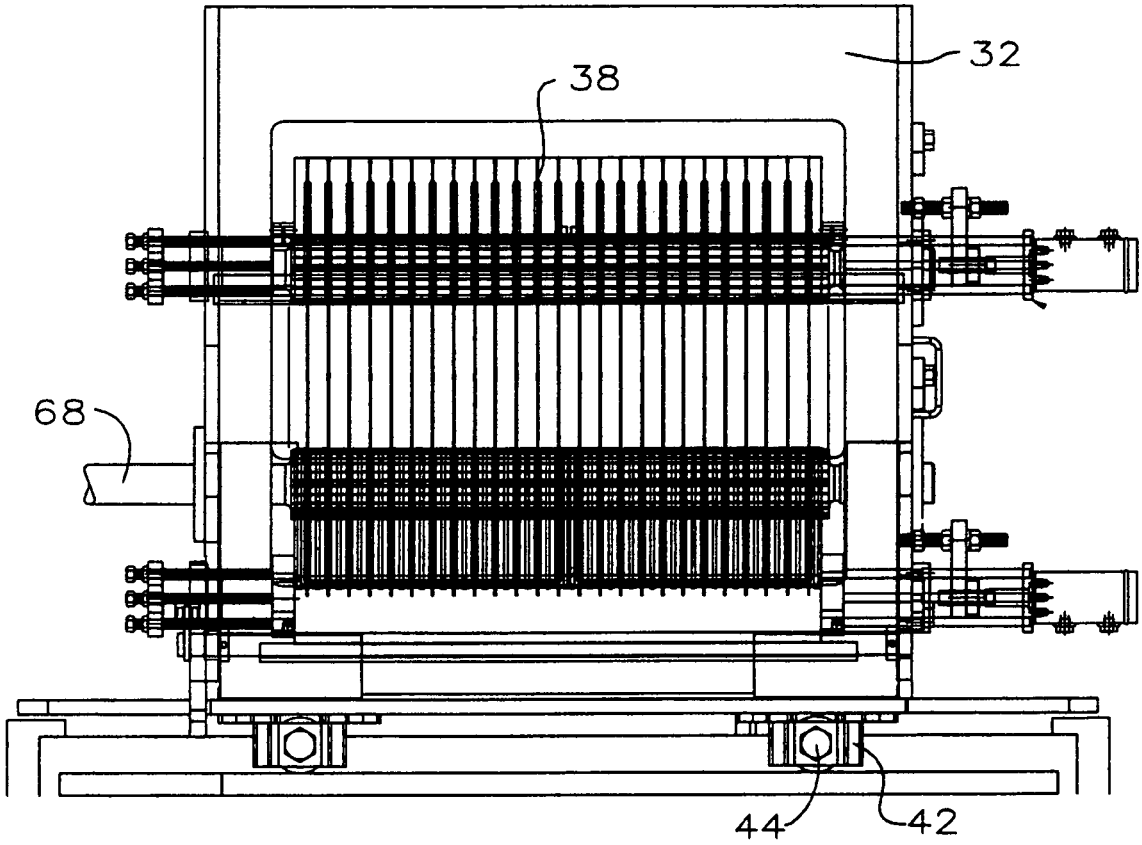
FIG. 6 is a sectional view of the gangsaw taken along line 6—6 in FIG. 3.

In the present state of the art, gangsaw machines are typically connected to one or more high horsepower (e.g. 1600 HP) electric motors 73 to drive the saw arbors 38. It is generally impracticable to move such motors in unison with saw arbors 38 as outfeed 32 is translated to open servicing gap 62. Rather, and as shown in FIGS. 4 and 5, it is preferable to provide flexible couplings on driveshaft 68 which extends from motors 73 to saw arbors 38. In the illustrated example, a universal joint 70 is coupled to a sleeve 72 having internal splines. A shaft 74, having splines at one end 74*a* to mate with sleeve 72, has a universal joint 78 at the other end to couple with the saw arbor. Splined sleeve 72 and the splined end 74*a* of shaft 74 permit ready translation of outfeed 32 relative to stationary infeed 30.

In alternative embodiments, motors 73 may move in unison with outfeed 32 if motors 73 are closely coupled to the saw arbors. In a further alternative embodiment, infeed 30 of the gangsaw may be translated relative to a fixed or sliding outfeed 32.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A split sawbox for a gangsaw comprising a sawbox having at least first and second mating sawbox sections, said sections linearly selectively translatable relative to one another along a workpiece flow path, by translation means for selective translation of said first and second mating sawbox sections relative to one another, between a closed position wherein said sections are releasably locked together, by selectively lockable locking means for selectively mating together said first and second mating sawbox sections for operation of the gangsaw, and an open position wherein, once said locking means are unlocked, said sections are linearly separated from one another by said translation means to open a gap between said first and second mating sawbox sections so that within said gap a workman may stand for maintenance of the gangsaw.

2. The device of claim 1 wherein said sections include an upstream infeed section and a downstream outfeed section, and wherein said sections translate relative to one another, and one of said sections remains fixed.

3. The device of claim 2 wherein said section which remains fixed is said upstream infeed section, and wherein said downstream outfeed section translates relative to said upstream infeed section along said flow path in the direction of flow of workpieces through the gangsaw.

4. The device of claim 1 further comprising a floor mounted adjacent the gangsaw on vertical translation means for selectively actuable movement of said floor between a retracted position retracted from between said sections so as to be out of said flow path when said sections are in said closed position, and an inserted position inserted between said sections for a workman to stand on said floor when said sections are in said open position.

5. The device of claim 1 further comprising fixed gangsaw motors which remain fixed relative to ground so as to not translate as the outfeed section translates between the open and closed positions and an articulating driveshaft operatively connected between said motor and the gangsaw to drive the saw arbors of the gangsaw.

6. The device of claim 5 wherein said sections separate along a separation interface, and wherein said separation interface is adjacent cutting machinery mounted in the gangsaw.

7. The device of claim 6 wherein said outfeed section is slidably mounted on horizontal slideways for horizontal translation of said outfeed section and wherein said translation means includes an actuator mounted to said outfeed section for actuation of said outfeed section relative to said infeed section.

8. The device of claim 6 wherein said separation interface is immediately upstream on an infeed side of the gangsaw for ease of entry by personnel for saw adjustment and maintenance.

9. The device of claim 8 further comprising horizontally aligned locking pins and receptacles which are mated and clamped across said separation interface when said infeed and outfeed sections are in said closed position so as to prevent accidental separation of said sections.

* * * * *